United States Patent [19]

Kulpa et al.

[11] 4,405,125

[45] Sep. 20, 1983

[54] PAPER STACKING DEVICE

[75] Inventors: Walter J. Kulpa, Norwalk; John R. Paulik, Newtown, both of Conn.

[73] Assignee: Pitney Bowes Inc., Stamford, Conn.

[21] Appl. No.: 301,719

[22] Filed: Sep. 14, 1981

[51] Int. Cl.[3] ..... B65H 29/24

[52] U.S. Cl. ..... 271/195; 271/211; 271/224

[58] Field of Search ..... 271/195, 211, 97, 98, 271/309, 223, 224

[56] References Cited

U.S. PATENT DOCUMENTS 1,107,859 8/1914 Stevens ..... 271/211

4,036,087 7/1977 Braun ..... 271/211 X

*Primary Examiner*—Richard A. Schacher

*Attorney, Agent, or Firm*—Lawrence E. Sklar; William D. Soltow, Jr.; Albert W. Scribner

[57] ABSTRACT

A levitating paper stacking device for stacking different length papers. The device includes a box-like receptacle having a bottom wall, a front wall, and a pair of sidewalls, and a fold-down, four bar linkage, perforated ramp. The ramp is movable between a raised position for stacking a shorter length paper and a stored position for stacking a longer length paper. The ramp includes three hinged segments wherein the forwardmost segment constitutes the rear wall of the receptacle when the ramp is in its raised position and wherein the forwardmost and middle segments constitute an addition to the bottom wall of the receptacle when the ramp is in its stored position. The device further includes means for automatically moving the ramp to its raised and stored positions, and means for directing a levitating air flow toward the rearwardmost segment when the rearwardmost segment is in its raised and stored positions, whereby the different length papers are conveyed to the front wall of the box-like receptacle with a minimum of bounceback.

2 Claims, 3 Drawing Figures

PAPER STACKING DEVICE

BACKGROUND OF THE INVENTION

The instant invention relates to stacking of papers, and more particularly to stacking different length papers using a fold-down perforated ramp to levitate documents and limit bounceback.

Papers exiting a roller nip on a ramp so that they can be stacked against a registration edge in the feed direction will tend to drop down and slide along the preceding papers, thereby causing three problems. The first problem is that static charges on the paper and friction prevent the papers from arriving at the proper location. The second problem is a complication due to handling two different length papers without requiring operator intervention so that, for example, 11 inch papers can travel the additional three inches required by 14 inch long papers. The third problem is that, when dealing with at least two different paper lengths, system to limit bounceback of the paper sheets is required in order that the papers be stacked in proper registration.

Air introduced through a narrow slot located directly below the document exit slot can provide a stream of air which levitates the paper sheets and avoids the frictional contact described previously. The momentum derived from the exit roller nip allows the paper sheet to proceed to the stack registration location unhampered by the contact friction avoided by the aforesaid airstream. In order that the levitating benefits of air introduced below the paper sheets be realized, the ramp must be perforated. Since different lengths of paper are to be accommodated, the perforated ramp must be retractable. However, when space is limited, this cannot be accomplished.

Accordingly, the instant invention overcomes the foregoing problems by providing a levitating, segmented ramp which can accommodate automatically, for example, the stacking of an 11 inch document in its raised position at the same leading edge location that the stored position of the ramp can accommodate 14 inch documents.

SUMMARY OF THE INVENTION

The instant invention provides a levitating paper stacking device for stacking different length papers. The device comprises a box-like receptacle having a bottom wall, a front wall, and a pair of sidewalls, and a fold-down, four bar linkage, perforated ramp. The ramp is movable between a raised position for stacking a shorter length paper and a stored position for stacking a longer length paper. The ramp includes three hinged segments wherein the forwardmost segment constitutes the rear wall of the receptacle when the ramp is in its raised position and wherein the forwardmost and middle segments constitute an addition to the bottom wall of the receptacle when the ramp is in its stored position. The device further includes means for automatically moving the ramp to its raised and stored positions, and means for directing a levitating air flow toward the rearwardmost segment of the ramp, wherein the airflow impinges on the rearwardmost segment when the rearwardmost segment is in its raised and stored positions, whereby the different length papers are conveyed to the front wall of the box-like receptacle with a minimum of bounceback.

DETAILED DESCRIPTION

Figure 1:
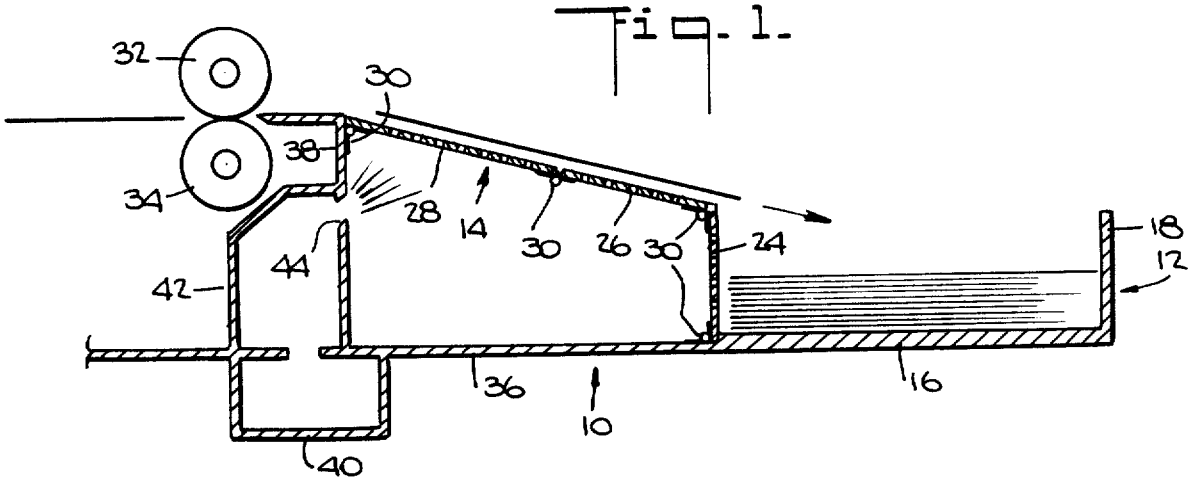
FIG. 1 is a vertical sectional view of a paper stacking device in accordance with the instant invention wherein the ramp is in its raised position to accommodate shorter length paper.
Figure 2:
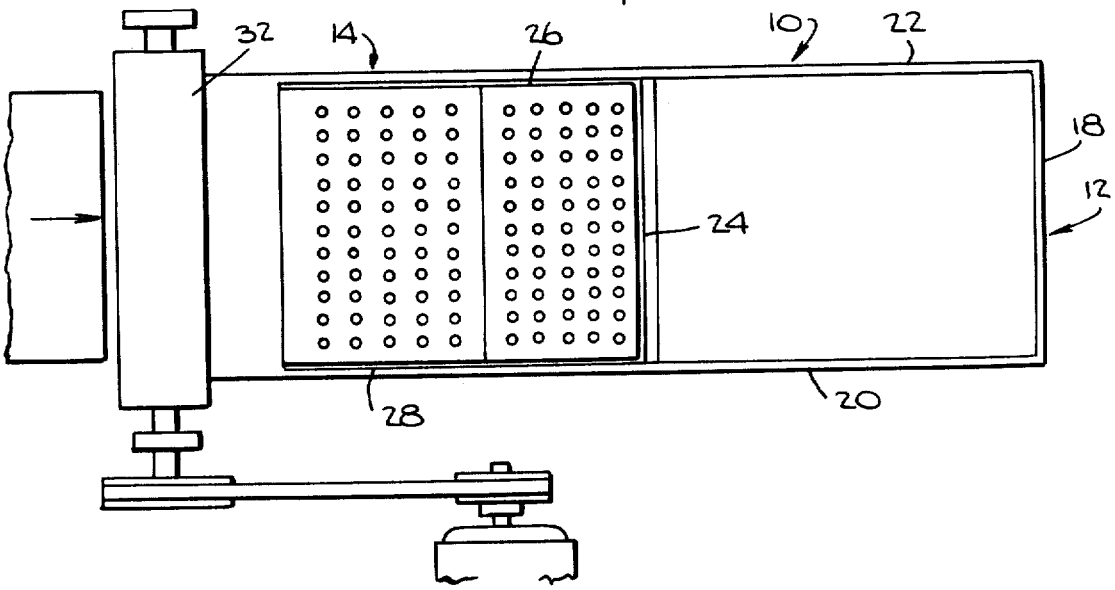
FIG. 2 is a top, plan view of the paper stacking device seen in FIG. 1.

In describing the preferred embodiment of the instant invention, reference is made to the drawings wherein there is seen a paper stacking device generally designated 10 consisting of a box-like receptacle 12 and a fold-down, four bar linkage, perforated ramp generally designated 14.. The receptacle 12 includes a bottom wall 16, a front wall 18 and a pair of sidewalls 20 and 22.

The ramp 14 includes three segments, namely a forwardmost segment 24, a middle segment 26 and a rearwardmost segment 28, each of which is connected to the other and ground by hinges 30. Each of the segments 24, 26 and 28 is perforated, but is it not necessary that the forwardmost segment 24 be perforated to the same extent as the other two segments.

The paper stacking device 10 is associated with a pair of exit feed rollers 32 and 34 such as, for example, from an electrophotocopying machine (not shown), for feeding sheets of paper 35 onto the ramp 14. The forwardmost segment 24 is hingedly connected to a base support 36 of the photocopier housing and the rearwardmost segment 28 is hingedly connected to a vertical support 38 of the photocopier housing. An air duct 40 is situated beneath the base support 36 and is operatively associated with an air plenum 42 having an air slot 44 for directing an air flow upwardly toward the rearwardmost segment 28 of the ramp 14. The device 10 also includes a solenoid (not shown) for rotating the rearwardmost segment 28 upward from the position seen in FIG. 3 to the position seen in FIG. 1.

In the operation of the paper stacking device 10, sheets of paper 35 are fed through the feed rollers 32 and 34 toward the box-like receptacle 12. If a shorter length paper, such as 11 inch long paper, is being fed, the ramp 14 is placed in the raised position shown in FIG. 1. Air directed through the slot 44 upward toward the rearwardmost segment 28 together with the momentum of the paper sheets 35 from the nip of the exit rollers 32 and 34 allow the sheets of paper 35 to proceed to the front wall 18 for registration. As seen in FIG. 1, the forwardmost segment 24 functions as the rear wall of the receptacle 12 when the ramp 14 is in its raised position.

Figure 3:
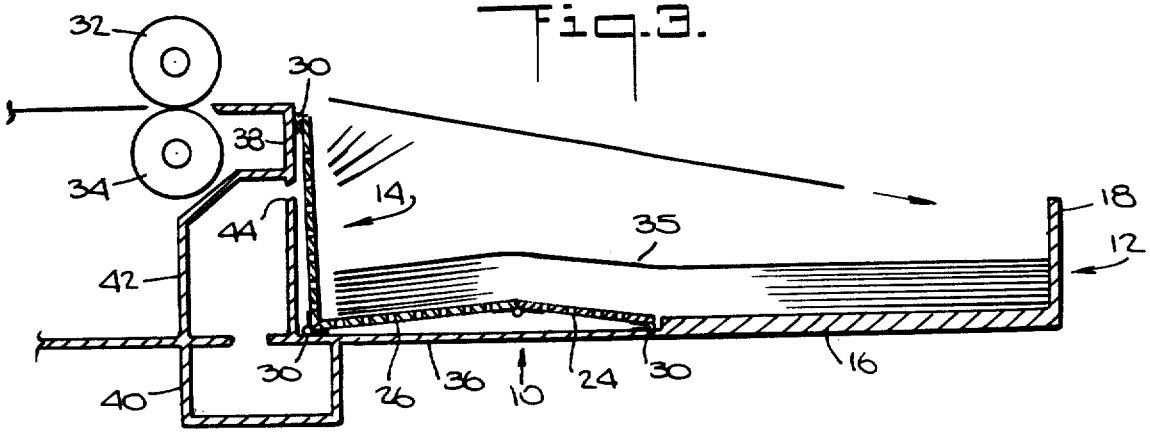
FIG. 3 is the same as FIG. 1 except the ramp is shown in its stored position accommodating longer length paper.

If a longer length paper, such as 14 inch paper, is being fed, the ramp 14 is collapsed to the stored position shown in FIG. 3. Movement of the ramp 14 between the raised and stored positions shown in FIGS. 1 and 3 respectively can be effected by conventional means, such as a solenoid which can rotate the rearwardmost segment 28, which in turn will cause the middle segment 26 and the forwardmost segment 24 to automatically follow the rearwardmost segment 28 . As seen in FIG. 3, when longer length paper is being fed, the forwardmost segment 24 and midle segment 26 function as an addition to the bottom wall 16 of the receptacle 12 to support the sheets of paper 35.

It will be understood by those skilled in the art that various changes in form and details may be made therein without departing from the spirit and scope of the present invention.

What is claimed is:

1. A levitating paper stacking device for stacking different length papers, comprising:

a box-like receptacle having a bottom wall, a front wall, and a pair of sidewalls;

a fold-down, four bar linkage, perforated ramp, said ramp being movable between a raised position for stacking a shorter length paper and a stored position for stacking a longer length paper, said ramp having three hinged segments wherein the forwardmost segment constitutes the rear wall of the receptacle when said ramp is in its raised position and wherein the forwardmost and middle segments constitute an addition to the bottom wall of the receptacle when the ramp is in its stored position; and means for directing a levitating air flow toward the rearwardmost segment of said ramp, wherein said airflow impinges on said rearwardmost segment when said rearwardmost segment is in its raised and stored positions, whereby the different lengths papers are conveyed to the front wall of the box-like receptacle with a minimum of bounceback.

2. The device of claim 1, wherein the forwardmost segment is less perforated than the other two segments.

* * * * *